United States Patent [19]

Taylor

[11] Patent Number: 4,822,481

[45] Date of Patent: Apr. 18, 1989

[54] RECOVERY OF HEAVY OIL

[75] Inventor: Alistair S. Taylor, Camberley, England

[73] Assignee: The British Petroleum Company p.l.c., London, United Kingdom

[21] Appl. No.: 84,800

[22] Filed: Aug. 13, 1987

[30] Foreign Application Priority Data

Aug. 27, 1986 [GB] United Kingdom ..... 8620706

[51] Int. Cl.[4] ..... C10G 1/04

[52] U.S. Cl. ..... 208/390; 208/435

[58] Field of Search ..... 208/390, 435

[56] References Cited

U.S. PATENT DOCUMENTS 4,017,377 4/1977 Fairbanks, Jr. et al. ..... 208/390
4,057,485 11/1977 Blaine ..... 208/390
4,067,796 1/1978 Alford et al. ..... 208/390
4,342,639 8/1982 Gagon ..... 208/390

FOREIGN PATENT DOCUMENTS 638886 3/1962 Canada ..... 208/390
1527269 10/1978 United Kingdom ..... 208/390

*Primary Examiner*—H. M. S. Sneed
*Assistant Examiner*—Chung K. Pak
*Attorney, Agent, or Firm*—Morgan & Finnegan

[57] ABSTRACT

Heavy crude oil is recovered from tar sand by treating the tar sand with a low concentration emulsion of a solvent in water containing 0.5 to 15% by volume of the solvent. Suitable solvents include hydrocarbons and halogenated hydrocarbons. Solvent-in-water emulsions are efficient in extracting bitumen with the major advantage of greatly reduced solvent: tar sand ratios.

7 Claims, 2 Drawing Sheets

Bitumen recovery vs disperse phase volume solvent-in-water emulsions stabilised by SDS at 25°C. 20 minute extraction Bitumen recovery vs disperse phase volume $CCl_4$-in-water emulsions. 20 min. extraction at 25°C.

RECOVERY OF HEAVY OIL

This invention relates to a method for the recovery of heavy crude oil, especially from tar sands.

As reserves of conventional crude oils (approximately 15° to 30° API) decline, increasing importance will be attached to efficient methods for recovering heavy crude oils (8°–12° API) and the even heavier bituments (less than 8° API). Most bitumens are associated with minerals such as clays and quartz, and are known as tar sands.

The Alberta tar sands are among the largest deposits of their kind in the world and are estimated to contain about one trillion barrels of bitumen in place. The Athabasca region alone has reserves of 250 billion barrels. About 0.7 million acres of the Athabasca deposit is overlain by 150 ft., or less, of overburden and is potentially capable of being mined from the surface. The remaining 16.6 million acres are at such depths that the bitumen can only be recovered by in-situ methods.

The crude bitumen occurs in beds of sand and clay, usually partly connected together, and in porous carbonate rocks.

In high grade tar sand the pore space is filled with bitumen (typically 15–20% weight) and water.

In lower grade tar sands, i.e., containing less than 10% by weight bitumen, clusters of small particles exist within the framework formed by the coarse inorganic grains. These particles, known as fines, are saturated with water. Thus the amount of connate water in the tar sand increases with increasing fines content.

The bitumen typically has an API gravity of 7° and is denser than water at room temperature but becomes lighter than water at elevated temperatures.

In the case of deposits near the surface the overburden may be removed and the tar sand recovered by open cast mining.

Mined tar sands are refined by the hot water process. A description of this process is given in U.S. Pat. No. 4,474,616.

In broad summary, this process comprises first conditioning the tar sand, to make it amenable to flotation separation of the bitumen from the solids. Conditioning involves feeding mined tar sands, hot water (80° C.), an alkaline process aid (usually NaOH), and steam into a rotating horizontal drum wherein the ingredients are agitated together.

During conditioning, the mined tar sand in which the bitumen, connate water and solids are tightly bound together becomes an aqueous slurry of porridge-like consistency, wherein the components are in loose association.

The slurry leaving the drum is screened to remove oversize material and then flooded or diluted with additional hot water.

The bitumen is then recovered by primary and secondary froth flotation.

This process suffers from the disadvantages that bitumn/water emulsions are formed and the separated water contains colloidal dispersions of clay, fines and oil which are extremely stable and present serious problems in their disposal.

An alternative to this aqueous based process in solvent extraction, whereby the tar sand is contacted with an organic solvent which dissolves the bitumen. Numerous studies have been carried out with solvent based processes and certain advantages identified in terms of selectivity and low temperature operation. For example, Funk, Can. J. Chem. Eng. 57, 333, (1979), has shown that it is possible to extract the lighter components selectively from bituminous tar sand using paraffinic solvents thereby deasphalting (leaving precipitated asphalt behind) and recovering bitumen in a single stage. Cormack et al., Can. J. Chem. Eng. 55, 572, (1977), found that chlorinated and aromatic solvents may be used to extract bitumen completely at low temperatures. Sarbar et al., Can. J. Chem. Eng. 62, 267, (1984), have approached the problem by investigating the use of microemulsions and emulsions. However, the former has the disadvantage of requiring high concentrations of surfactant and solvent, about 50% by volume of the latter, whereas the latter, particularly at high solvent:water ratios, may cause problems with high emulsion viscosities restricting recovery.

For deposits at a greater depth, the technique of jet leaching can be employed. Jet leaching is a known technique for the extraction of tar sands which comprises drilling and fixing casing until the pay zone is reached. The mineral is then fragmented by directing high velocity jets of water onto it and the bitumen is pumped to the surface, leaving most of the solid particles downhole.

We have now discovered that low concentration solvent in water emulsions are effective in extracting bitumen from tar sands and do not suffer from the above disadvantages. By low concentration we mean containing 15% or less by volume of the disperse phase.

Thus according to the present invention there is provided a method for the recovery of heavy crude oil from heavy crude oil associated with a solid inorganic substance (and optionally water), hereinafter referred to as the material, which method comprises treating the material with a low concentration emulsion of a solvent in water containing 0.5 to 15%, preferably 5 to 10% by volume, of the solvent and recovering the heavy crude oil.

The degree of recovery may be controlled by the type of solvent, the disperse phase volume and the nature of the stabilizing surfactant.

Suitable solvents include hydrocarbons and halogenated hydrocarbons.

A wide variety of hydrocarbons can be employed including partially refined petroleum fractions, eg, side cuts from crude columns, crude column overheads, gas oils, kerosine, heavy naphthas, naphthas, and straight run gasoline. Pure hydrocarbons are also useful, e.g. paraffinic compounds including hexane, heptane, decane and dodecane; cyclo-paraffin compounds including cyclohexane; aromatic compounds including benzene, naphthalene and alkylated products thereof including toluene and alkyl phenyls, and mixtures of these compounds.

Preferred halogenerated hydrocarbons include chlorinated and/or fluorinated derivatives of methane and ethane, e.g. carbon tetrachloride, dichloromethane and trichloro-trifluoro-ethane.

Any water source can be used for the preparation of the solvent/water emulsions provided that its salinity is not so high that it affects the stability of the emulsion. Conveniently a local water source is chosen and mixed with brine from the reservoir to be worked so that a homogeneous emulsion having maximum compatability with reservoir fluids can be evolved.

The emulsions are preferably stabilized by a surfactant. Suitable surfactants include anionic, cationic and non-ionic surfactants.

Suitable anionic surfactants include alkyl sulphates and alkyl aryl sulphonates.

Suitable cationic surfactants include quaternary ammonium salts such as cetyl trimethyl ammonium bromide.

Suitable non-ionic surfactants include ethoxylated alkyl phenols, e.g., ethoxylated nonyl phenol.

Suitable concentrations of surfactant are in the range 0.01 to 5% by weight of the emulsion.

In the case of systems stabilized by anionic and non-ionic surfactants, the recovery of bitumen may be further improved by adding an alkali such as sodium hydroxide to the system, suitably in amount to give a pH in the range 10 to 12.

The treatment is suitable for recovering bitumen from previously mined tar sand deposits.

The emulsion system is effective at lower temperatures than the hot water system and thus requires less energy for this purpose. Suitable treatment temperatures are in the range 0° to 60° C., preferably 0° to 30° C. C.

Solvent-in-water emulsions are efficient in extracting bitumen with the major advantage of greatly reduced solvent:tar sand ratios. This makes the process more economical (compared with solvent only routes) and also reduces environmental problems. Product separation is also easier.

The treatment is also suitable for in-situ recovery from a reservoir, for example by jet leaching as hereinbefore described.

In this type of process, because the solvent is introduced to the reservoir in a continuous aqueous phase, solvent losses are minimal. Furthermore, the use of emulsions in a jet leaching process effectively reduces the processes of production and extraction to a single stage. The presence of relatively small (ca 5%) quantities of solvent in the emulsion increases leaching rates and the diluted bitumen product, due to its lower viscosity and larger density difference (between bitumen, water and sand), is more easily treated and transported. Because such an operation can be carried out at ambient temperature, the formation of emulsions in jet leaching improves the cost effectiveness of such a process.

Figure 1:
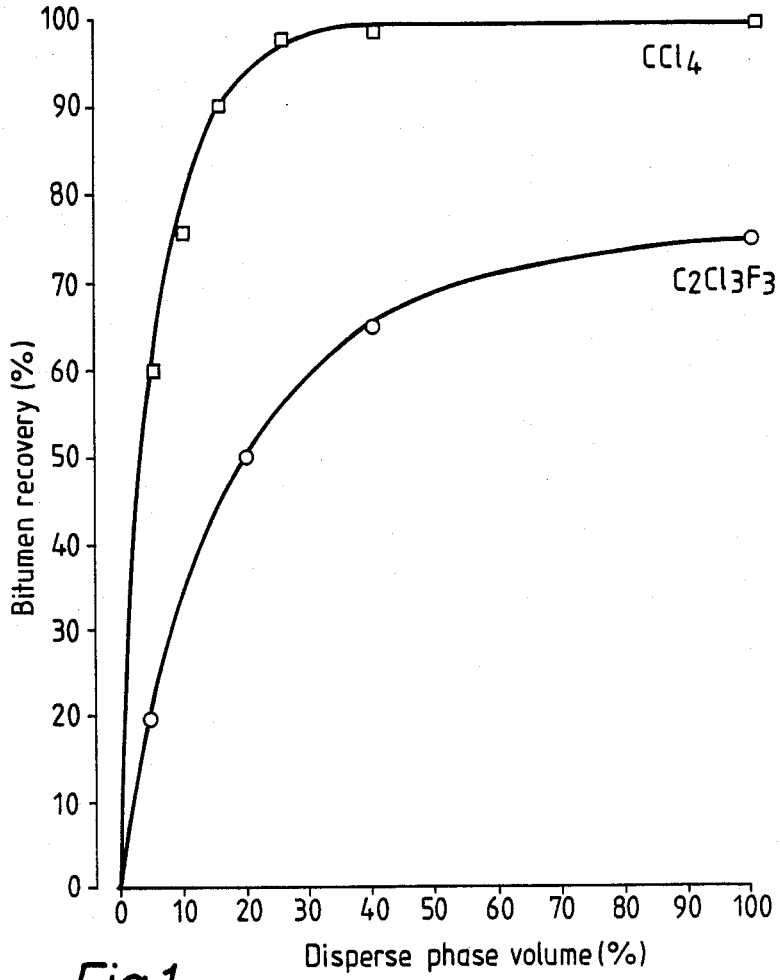
FIG. 1 is a graph showing bitumen recovery is governed by the dispense phase volume and type of solvent in the emulsion.

The invention is illustrated with reference to the following examples.

EXAMPLES

The material studied was a high grade Athabasca tar sand containing approximately 16% by weight bitumen homogeneously distributed throughout the sand mix.

A weighed sample of tar sand (typically 0.5 g) and a measured quantity of the extraction medium (10 ml) were placed together in a round bottom flask which was immersed in a thermostatted bath. A water cooled condenser was fitted to minimise evaporative losses. Exractions were carried out with agitation at 25° C.

The amount of bitumen removed from the tar sand was quantified gravimetrically after separation from the extracting medium and the free bitumen. The extracted sand was washed with double distilled water until all free bitumen had been removed. The sand was then filtered through a sintered glass funnel and dried in an oven at 50° C. to constant weight.

Carbon tetrachloride and trichloro-trifluoro-ethane emulsions were prepared using an Ultra-Turrax high shear mixer. Emulsification times were 20 seconds at 4000 rpm for the 5% oil-in-water emulsions and 40 seconds at 4000 rpm for the higher phase volume. The emulsions were stabilized by a variety of surfactants and the mean droplet diameter (by Coulter Counter) found to be between 5 and 8 micron.

EXAMPLE 1

In Example 1, bitumen recovery vs disperse phase volume solvent-in-water emulsions was studied.

The stabilizing surfactant was sodium dodecyl sulphate. Extractions were carried out at 25° C. for 20 minutes.

The results are set out graphically in the accompanying FIG. 1.

The results shown in FIG. 1 indicate that the degree of recovery is governed by the disperse phase volume and the type of solvent in the emulsion. The maximum recovery which may be obtained using an oil-in-water emulsion is determined by the relative efficiency of the solvent component. Therefore as the disperse phase volume is increased recovery increases and tends to a maximum corresponding to the pure solvent. The type of solvent would also appear to determine the importance of the disperse phase volume. Therefore for a very efficient solvent such as carbon tetrachloride at disperse phase volumes greater than ca 25% (v/v) a recovery of ca 100% is obtained which is equivalent to the pure solvent. For a less efficient solvent, e.g. trichloro-trifluoro-ethane, recovery increases more slowly with disperse phase volume and tends to a maximum at a phase volume between 70 and 80%.

These results illustrate that solvent-in-water emulsions may be used to recover bitumen from tar sands with a significant saving of solvent (four fold in the case of carbon tetrachloride). This is presumably due to better dispersion of the carbon tetrachloride throughout the tar sand matrix and better contact through the larger solvent interfacial area. However, the amount of this saving is determined by the solvent which also controls the maximum recovery attainable by this method.

EXAMPLE 2

In Example 2, bitumen recovery vs disperse phase volume of carbon tetrachloride in water was studied for various stabilizing surfactants, some with the addition of alkali.

Surfactants selected for study were;
sodium dodecylsulphate (SDS)
ethoxylated nonyl phenol condensate $(NP/EO)_{20}$)
cetyltrimethyl ammonium bromide (CTAB)
sodium dodecyl benzene sulphonate (SDBS).

SDBS at pH 11.7
$NP(EO)_{20}$ at pH 11.7

Extractions were carried out as before at 25° C. for 20 minutes.

Figure 2:
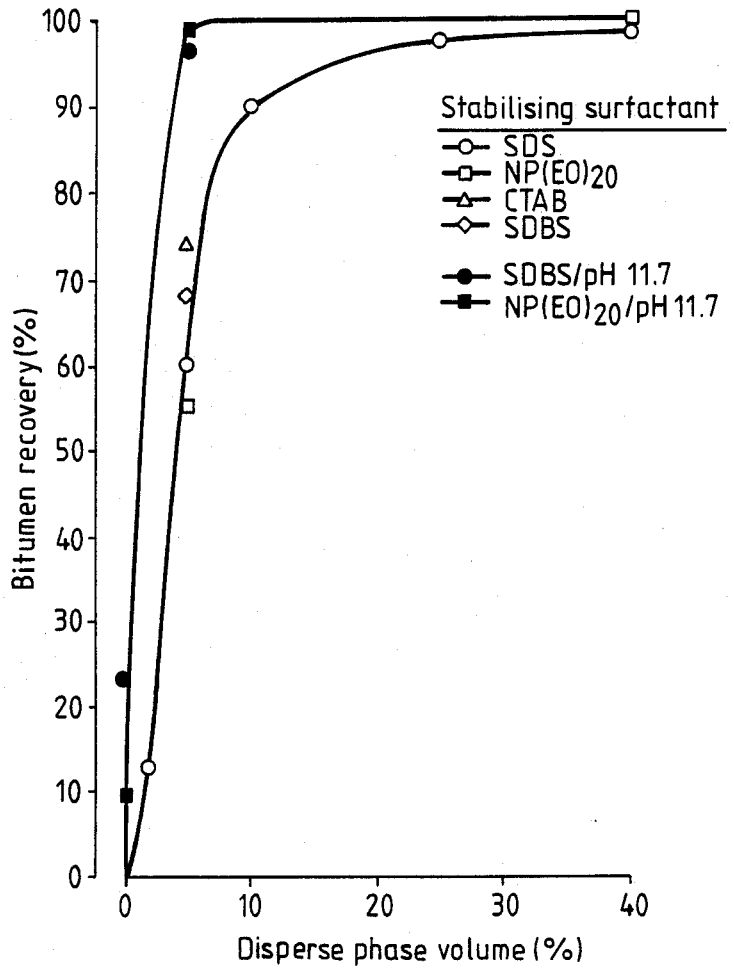
FIG. 2 is a graph showing the affect of various surfactants, some with the addition of alkali, on bitumen recovery vs dispense phase volume of carbon tetrachloride.

The results quoted in Example 1 are for emulsions stabilized by an anionic surfactant, SDS. The effect of changing the stabilizing surfactant to a nonionic or cationic surfactant is shown in FIG. 2.

The recovery of bitumen by emulsions may be further improved by the addition of alkali. This is illustrated by the results shown in FIG. 2 for emulsions stabilized by a mixture of sodium hydroxide (at the optimum pH) and an anionic or nonionic surfactant. In these examples maximum recover (98%) is obtained with a disperse phase volume of only 5% carbon tetrachloride. This represents a 20 fold saving of carbon tetrachloride (cf pure solvent).

I claim:

1. A method for the recovery of heavy crude oil from tar sands, which method comprises treating said tar sands with an emulsion of a solvent in water, adding an alkali to the resulting mixture to give a pH in the range of 10 to 12 and recovering the heavy crude oil characterized by the fact that the emulsion contains 0.5 to 15% by volume of the solvent said solvent being a chlorinated and/or fluorinated derivative of methane or ethane.

2. A method according to claim 1 wherein the concentration of said solvent in the emulsion is in the range 5 to 10% by volume.

3. A method according to claim 1 wherein additional water is introduced with said tar sand.

4. A method according to claim 1 wherein the emulsion is stabilized by a surfactant.

5. A method according to claim 4 wherein the surfactant is an anionic or non-ionic surfactant.

6. A method according to claim 5 wherein an alkali is added to the system in amounts to give a pH in the range 10 to 12.

7. A method according to claim 1 wherein the treatment is effected at a temperature in the range 0° to 60° C.

* * * * *